US007597583B2

(12) United States Patent
Zhuang

(10) Patent No.: US 7,597,583 B2
(45) Date of Patent: Oct. 6, 2009

(54) ELECTRICAL CONNECTOR HAVING A LED DEVICE THEREON

(75) Inventor: Quan Zhuang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,697

(22) Filed: Sep. 30, 2008

(65) Prior Publication Data

US 2009/0124135 A1 May 14, 2009

(30) Foreign Application Priority Data

Nov. 12, 2007 (CN) ..... 2007 2 0042232 U

(51) Int. Cl.
*H01R 3/00* (2006.01)

(52) U.S. Cl. ..... 439/490; 439/910

(58) Field of Classification Search ..... 439/315, 439/488, 490, 910

See application file for complete search history.

(56) References Cited

U.S. PATENT DOCUMENTS 5,601,451 A * 2/1997 Driones et al. ..... 439/490
5,885,100 A * 3/1999 Talend et al. ..... 439/490
5,915,993 A * 6/1999 Belopolsky et al. ..... 439/490
5,924,889 A * 7/1999 Wang ..... 439/490
6,409,530 B1 6/2002 Zhao et al.
6,773,298 B2 * 8/2004 Gutierrez et al. ..... 439/490
7,044,791 B2 * 5/2006 Wang ..... 439/607
7,074,083 B2 * 7/2006 Hyland ..... 439/607
7,083,468 B2 * 8/2006 Walker et al. ..... 439/541.5
2003/0134536 A1 * 7/2003 Wallace ..... 439/490

* cited by examiner

*Primary Examiner*—James Harvey
(74) *Attorney, Agent, or Firm*—Wei Te Chung

(57) ABSTRACT

An electrical connector includes an insulating housing (1) defining a mating face and a cylindrical receiving space (13) running though the mating face. A plurality of terminals is retained in the insulating housing and each includes contacting portions projecting to the receiving space and solder portions extending downwardly out of the housing. A retaining device (6) is individually formed and has a second portion (63) located at a rear portion of the housing for receiving the solder portions of the terminals and a first portion (61) located under a bottom wall of the housing. An indicating device (5) is received in the first portion (61) and facing the mating face.

11 Claims, 6 Drawing Sheets

6

ELECTRICAL CONNECTOR HAVING A LED DEVICE THEREON

BACKGROUND OF THE INVENTION

1. Field of the Invention

The present invention relates to an electrical connector, and particularly to a sunk electrical connector having a light emitting diode (LED) device thereon.

2. Description of the Prior Art

U.S. Pat. No. 6,409,530 issued to Zhao et al. on Jun. 25, 2002, discloses an electrical connector having a LED device thereon. The LED device is used for indicating the status of the power transmission between the electrical connector and a power plug. The electrical connector comprises an insulative housing defining a receiving space therein and a plurality of terminals mounted on the insulative housing and facing the receiving space for mating with the power plug. However, the LED device is often mounted on a top face of the insulative housing and takes up a large space, thereby increasing the height of the electrical connector and being inconsistent with the miniaturization trend of the electrical connector. Therefore, an electrical connector is needed to solve the problem.

SUMMARY OF THE INVENTION

Accordingly, an object of the present invention is to provide an electrical connector sunkly mounted onto a Printed Circuit Board (PCB), which is a low profile structure with a LED device thereon.

In order to achieve the object set forth, an electrical connector comprises an insulative housing defining a mounting face adapted for engaging with a printed circuit board (PCB). A plurality of terminals and a retaining device are mounted on the insulative housing. An indicating device is received in the retaining device and located under said mounting face.

Other objects, advantages and novel features of the invention will become more apparent from the following detailed description of the present embodiment when taken in conjunction with the accompanying drawings.

DETAILED DESCRIPTION OF THE INVENTION

Figure 1:
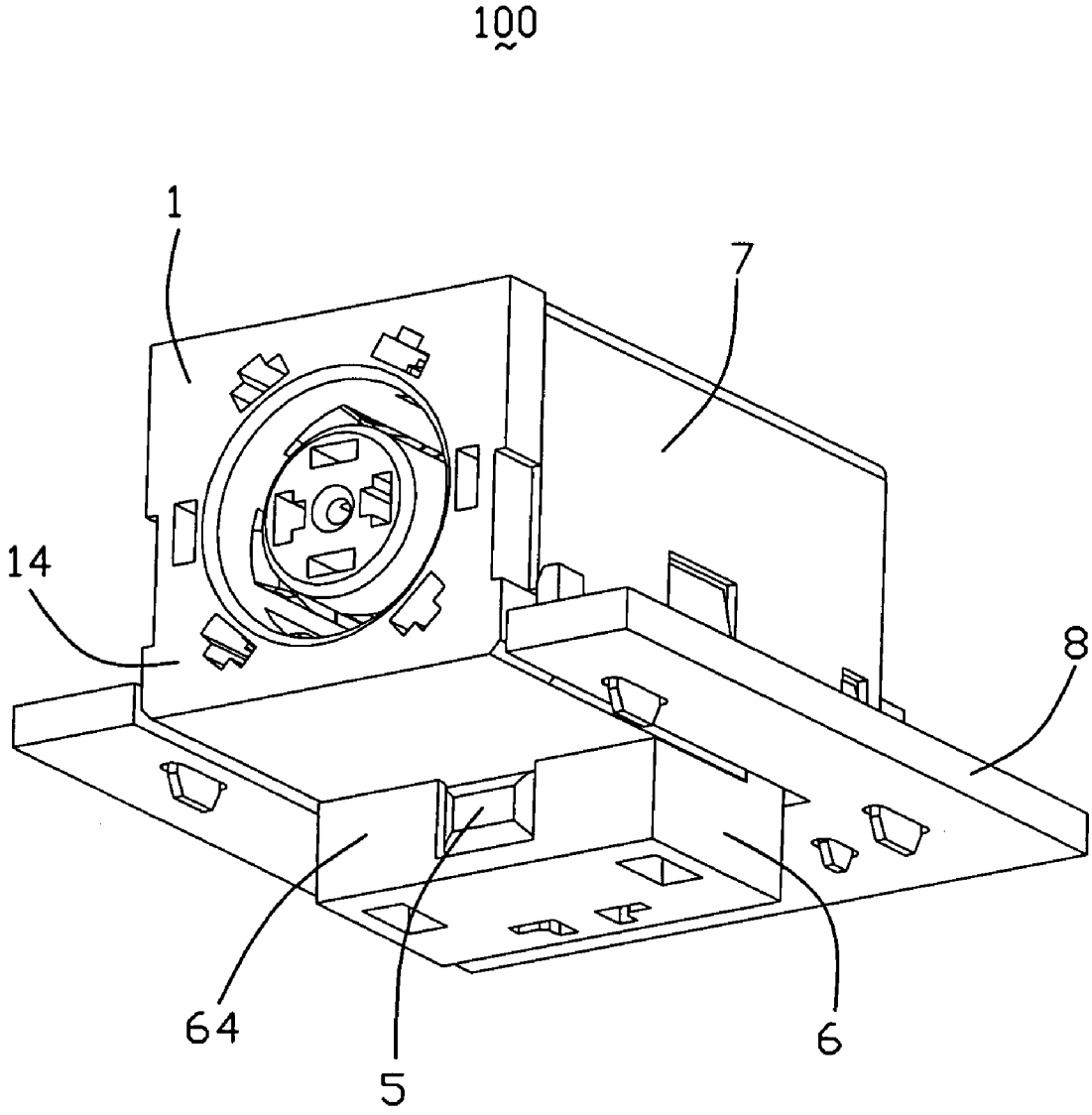
FIG. 1 is a perspective view of a sunk electrical connector in accordance with the present invention mounted onto a PCB.
Figure 2:
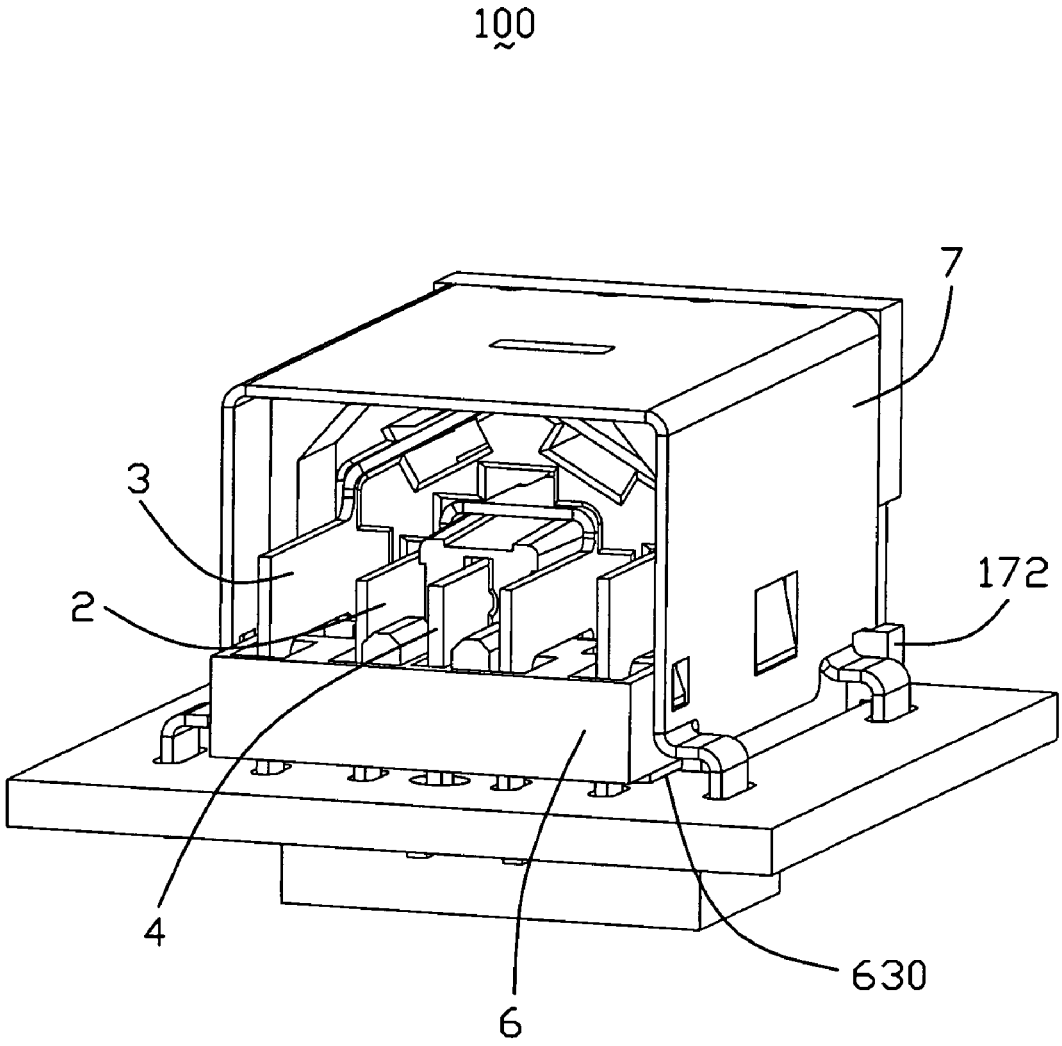
FIG. 2 is another view of the electrical connector shown in FIG. 1.

Reference will now be made to the drawing figures to describe a preferred embodiment of the present invention in detail. Referring to FIGS. 1 and 2, an electrical connector 100 according to the preferred embodiment of the present invention is provided and comprises an insulating housing 1, terminals, a LED device 5 and a retaining device 6 mounted on the housing 1 and a shell 7 surrounding the housing 1.

Figure 3:
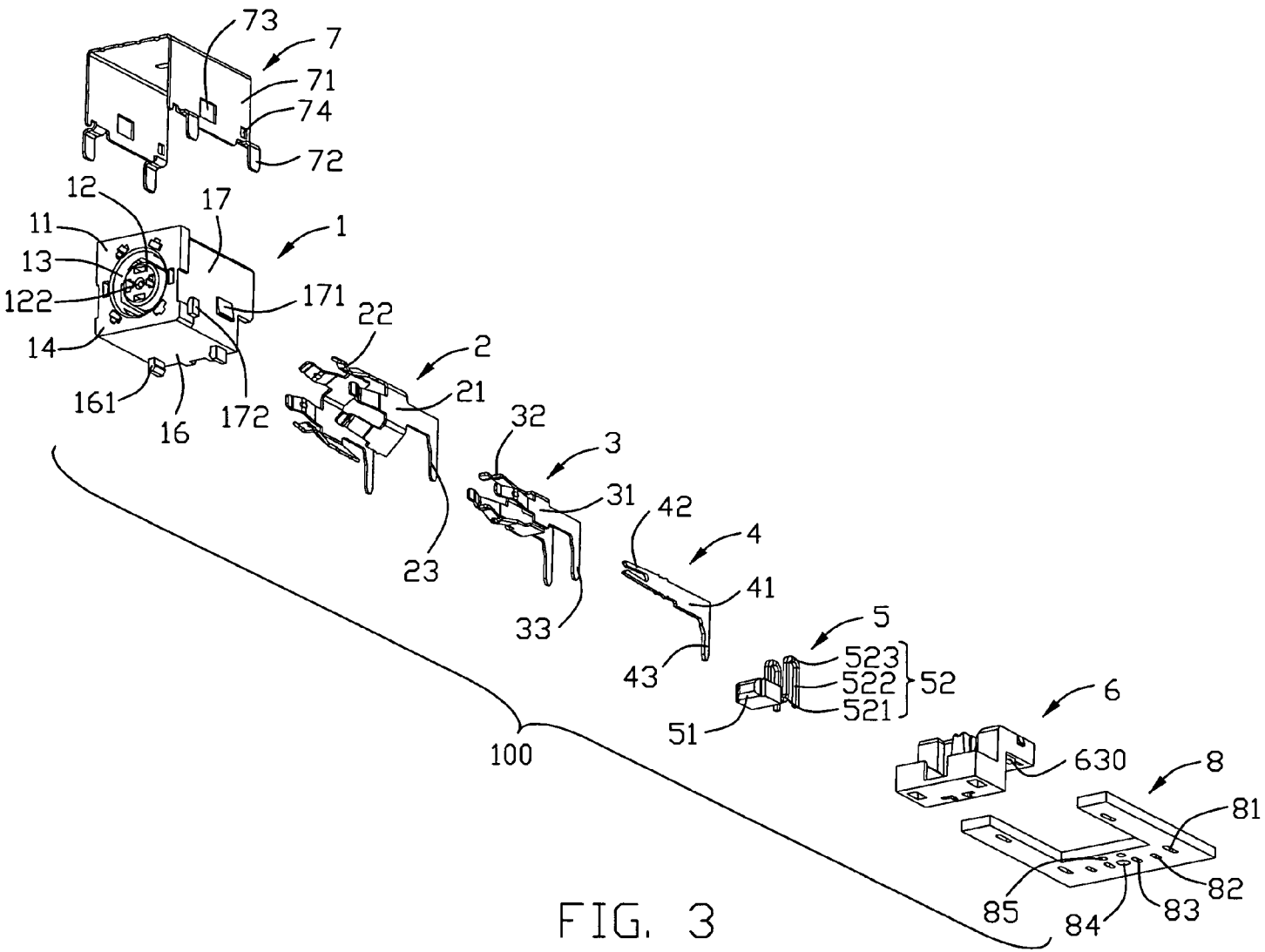
FIG. 3 is an exploded view of the electrical connector shown in FIG. 1.
Figure 4:
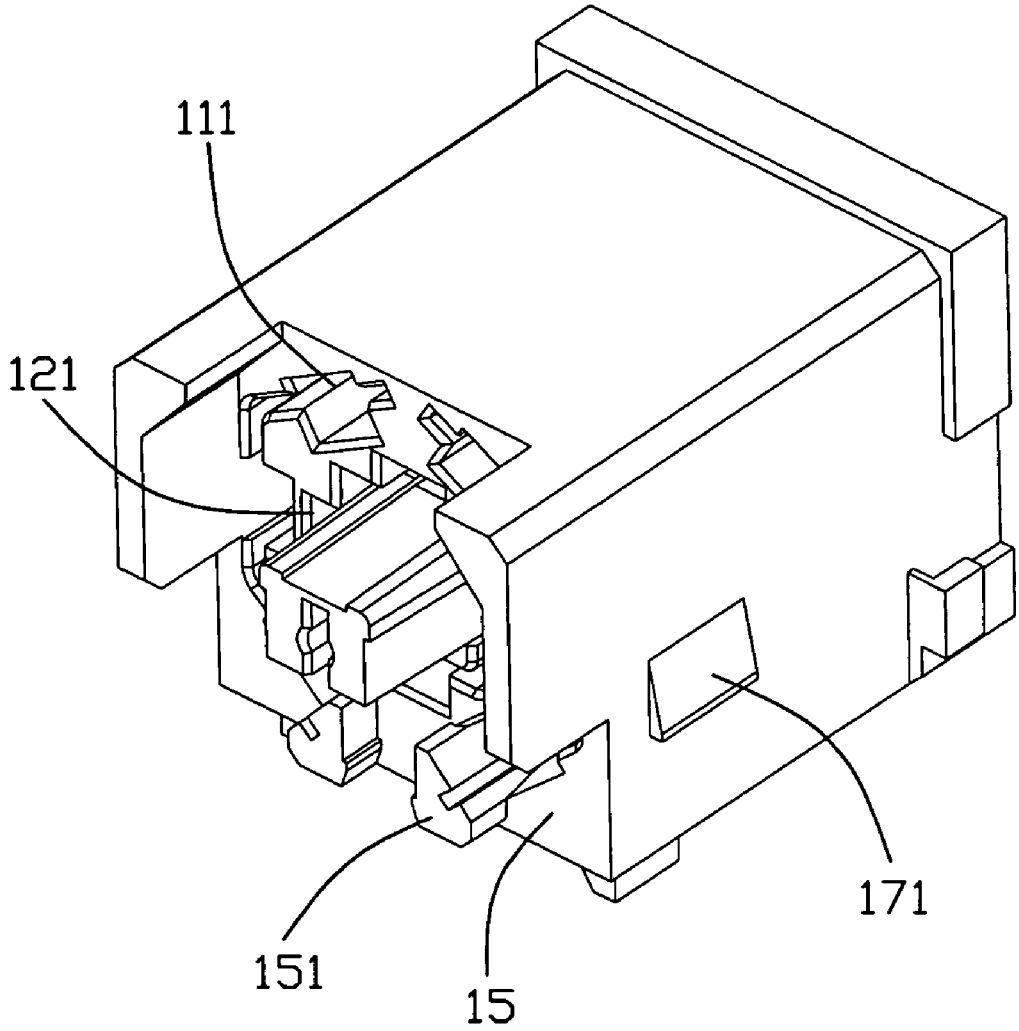
FIG. 4 is a perspective view of an insulative housing of the electrical connector shown in FIG. 1.

Referring to FIGS. 3 and 4, the insulative housing 1 has a first housing 11 in a rectangular shape and defining a mating space 13 therein and a second housing 12 in a cylindrical shape and extending into the mating space 13 from a rear end of the first housing 11. Therefore the mating space 13 is defined between the first housing 11 and the second housing 12 and extends from a front face 14 to a rear face 15 of the housing 1. A passageway 122 extends from the front face 14 to the rear face 15 of the second housing 12 along an axis of the second housing 12. A first and a second receiving grooves 111, 121 parallel to the passageway 122 are respectively defined in the first and second housings 11, 12 and run through the housing 1. The first receiving groove 111 is a hexagonal shape while the second receiving groove 121 is a quadrangular shape. A pair of locking portions 161 are respectively formed on a bottom wall 16 of the housing 1 adjacent to side walls 17. A block portion 171 and a supporting portion 172 are respectively formed on each side wall 17. A pair of extending portions 151 protrude rearward from a rear wall 15 of the housing 1.

First terminal 2 and second terminal 3 are made of metal sheets and respectively comprises a retaining portion 21, 31 retained in the first and second receiving grooves 111, 121, a contacting portion 22, 32 extending from one end of the retaining portion 21, 31 and partly exposed in the mating space 13, and a solder portion 23, 33 extending rearward and downward from the other end of the retaining portion 21, 31 and projecting out of the housing 1 for soldering on a PCB 8. A central terminal 4 comprises a body portion 41 fixed in the passageway 122, a fork shaped mating portion 42 extending forward from the body portion 41 and a solder leg 43 extending rearward from the body portion 41 and projecting out of the housing 1 for soldering on the PCB.

The LED device 5 comprises a main portion 51 and a pair of legs 52 extend from a rear end of the main portion 51. Each leg 52 includes a first extending leg 521 and a second extending leg 522 parallel to each other and a connecting portion 523 connecting the first and second extending legs 521, 522. The main portion 51 has LED therein and can indicate the status of the power transmission between the electrical connector and a power plug.

Figure 5:
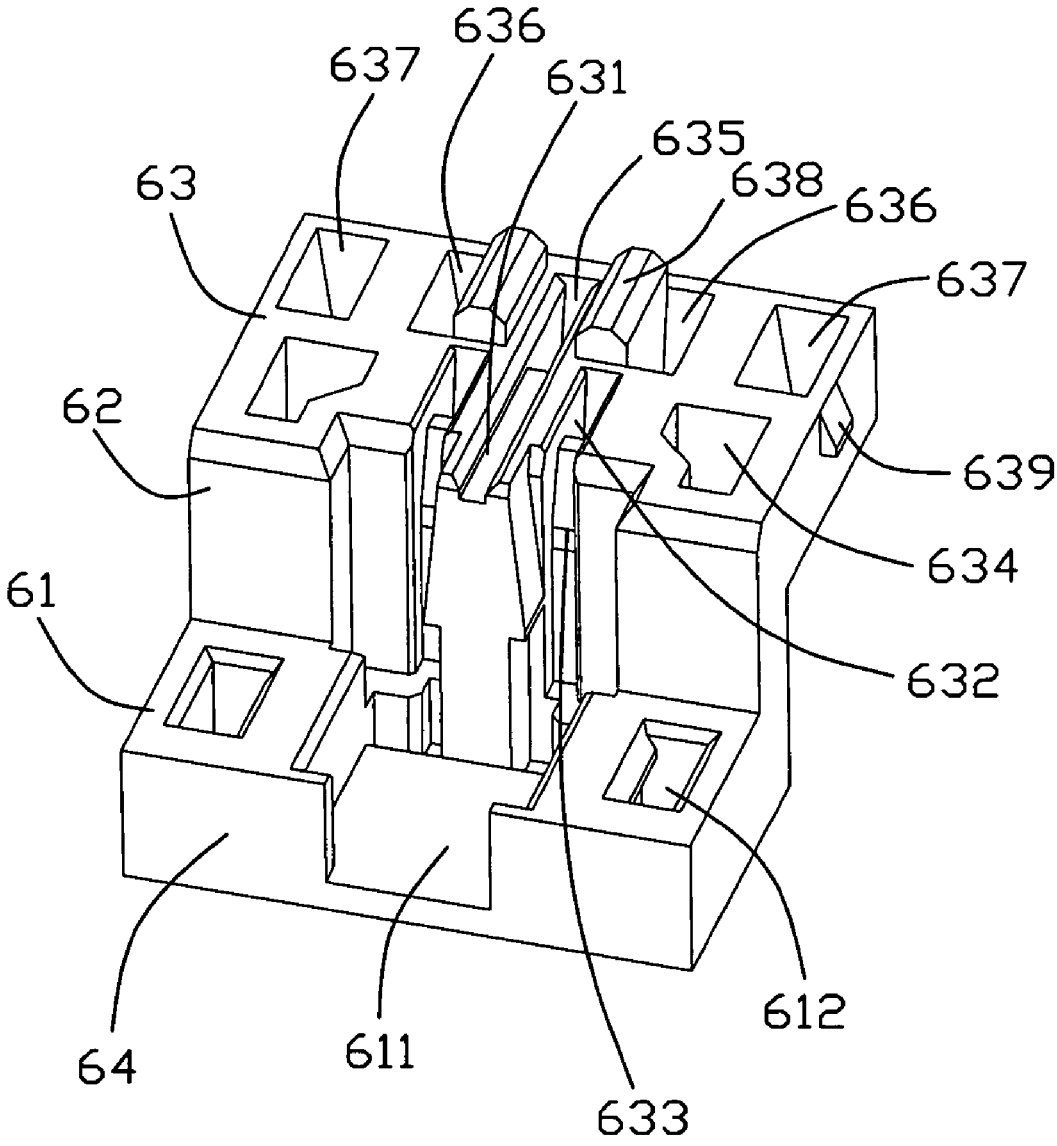
FIG. 5 is a perspective view of a retaining device of the electrical connector shown in FIG. 1.
Figure 6:
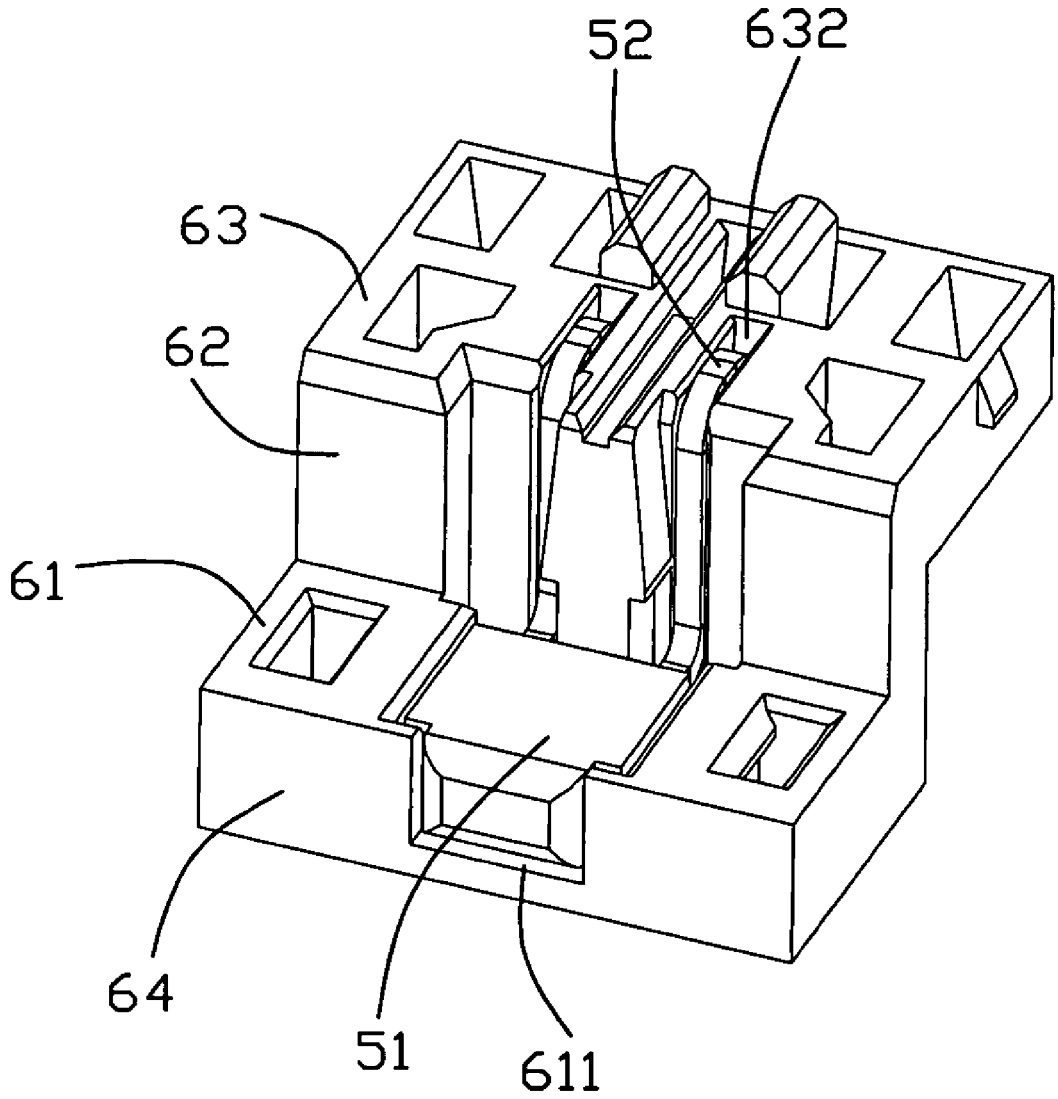
FIG. 6 is a perspective view of a LED device mounted on the retaining device of FIG. 5.

Referring to FIGS. 5 and 6, the retaining device 6 is in a step shape and comprises a first stage 61, a link portion 62 perpendicularly extending upward from edge of the first stage 61, and a second stage 63 horizontally extending rearward from edge of the link portion 62. A receiving cavity 611 for receiving the main portion 51 of the LED device 5 is defined in a middle portion of the first stage 61, and a pair of apertures 612 for receiving the locking portions 161 is defined at opposite sides of the receiving cavity 611. The LED device 5 is inserted into the receiving cavity 611 of the retaining device 6 and the LED device 5 together with the retaining device 6 form a module to be mounted onto the insulative housing 1. The module is assembled at a bottom wall of the housing near the rear wall, the first stage 61 abuts against the bottom wall and the second stage 63 is located above the first stage 61 and behind the rear wall of the housing.

A transverse groove 631 is defined in a middle portion of the second stage 63 adjacent to the link portion 62 for receiving the body portion 41 of the central terminal 4, and two through holes 632 are respectively defined at opposite sides of the transverse groove 631 for receiving the legs 52 of the LED device 5. Each groove 631 forms a rib 633 therein, the connecting portion 523 of the LED device abuts against top of the rib 633, and the first and second extending legs 521, 522 are located at opposite sides of the rib 633. The second extending leg 522 extends out of the through hole 632 for soldering on the PCB. A pair of grooves 634 are respectively formed at opposite edges of the second stage 63 adjacent to the link portion 62 for receiving the extending portions 151 on the rear of the housing 1. A receiving channel 635 is defined in a rear end of the transverse groove 631 and runs through the second stage 63 in a perpendicular direction for receiving the solder leg 43 of the central terminal 4. A plurality of receiving holes 636, 637 is respectively defined at opposite sides of the receiving channel 635 for receiving the solder portions 23, 33 of the first and second terminals 2, 3. A blocking portion 638 is formed in the receiving hole 636 and protrudes a top face of the receiving hole 636, which is used to fix the solder portion 33 of the second terminal 3 and prevent the solder portion 33 from connecting with the second extending leg 522 of the LED device 51. A pair of protrusions 639 are respectively defined at the opposite side walls of the second stage 63. Referring to FIG. 3, the second stage 63 forms a pair of supporting portions 630 on a bottom wall.

The shell 7 is surrounding the insulative housing 1, and forms a plurality of solder portions 72 extending downwardly from a side wall 71. A plurality of openings 73, 74 is defined on the side wall 71 to lock with the block portion 171 on the insulative housing 1 and protrusions 639 on the second stage 63 of the retaining device 6. The PCB 8 defines a plurality of through holes 81, 82, 83, 84, 85 for respectively receiving the solder portions 72 of the shell 7, solder portions 23, 33 of the first and second terminal 2, 3, solder leg 43 of the central terminal 4 and the second extending legs 522 of the LED device.

Referring to FIG. 2, the front face 14 of the housing 1 acts as a mating face and the LED device 5 is located at a rear portion of the housing behind the mating face. The supporting portions 172, 630 of the side wall 17 and retaining device 6 abut against the PCB 8 when the electrical connector is mounted onto the PCB, therefore the supporting portions 172, 630 define a mounting face for the sunk electrical connector. As the LED device 5 is located under the mounting face, hence, when the electrical connector is mounted onto the PCB, the LED device is located under the PCB and will not increase the height of the electrical connector above the mounting face.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sunk electrical connector comprising:

an insulative housing defining a mounting face adapted for engaging with a printed circuit board (PCB);

a plurality of terminals mounted on the insulative housing;

a retaining device mounted on the insulative housing; and an indicating device received in the retaining device and located under said mounting face;

wherein the insulative housing and the retaining device form a plurality of supporting portions on periphery portions, said supporting portions are engaging with the PCB when the electrical connector is mounted onto the PCB, and said mounting face is between the supporting portions and the PCB.

2. The electrical connector as described in claim 1, wherein the insulative housing defines a mating face, the indicating device is located behind the mating face.

3. An electrical connector assembly comprising:

a printed circuit board defining a notch;

an electrical connector including:

an insulative housing received in the notch and providing a mating port above the printed circuit board with terminals therein;

an indicating device associated with the housing and located below the printed circuit board;

wherein said indicating device is held in a retainer which is attached to the housing and defining through holes to retain terminal tails of said terminals for mounting to the printed circuit board.

4. The electrical connector as described in claim 1, wherein the retaining device comprises a first stage, a second stage parallel to and offset to the first stage and a link stage connecting the first stage and second stage, said second stage is located at a rear portion of the housing and said first stage is located under a bottom portion of the housing.

5. The electrical connector as described in claim 4, wherein the indicating device is received in a receiving cavity defined on the first stage.

6. The electrical connector as described in claim 4, wherein the indicating device comprises a main portion received in the first stage and a pair of legs extending upwardly to received in the second stage.

7. The electrical connector as described in claim 4, wherein each of said terminals has solder portions extending downwardly and received in the second stage of the retaining device.

8. A sunk electrical connector for mounting onto a printed circuit board (PCB) comprising:

an insulating housing defining a mating face for facing a mating connector face and a cylindrical receiving space running though the mating face;

a plurality of terminals retained in the insulating housing and each comprising contacting portions projecting to the receiving space and solder portions extending downwardly out of the housing;

a retaining device individually formed and comprising a second portion located at a rear portion of the housing for receiving the solder portions of the terminals and a first portion located under a bottom wall of the housing; and an indicating device received in the first portion and facing the mating connector.

9. The electrical connector as described in claim 8, wherein the first portion is parallel and offset to the second portion, the second portion is above the PCB while the first portion is under the PCB when the electrical connector is mounted onto the PCB.

10. The electrical connector as claimed in claim 3, wherein said retainer is of a Z-shaped configuration having a part located outside the notch and above the printed circuit board and another part located within the notch and below said printed circuit board.

11. The electrical connector as claimed in claim 3, wherein said indicating device is rearwardly offset from the mating port.

* * * * *